United States Patent [19]

Much

[11] 4,182,072

[45] Jan. 8, 1980

[54] TOY CONSTRUCTION KIT

[76] Inventor: Joe Much, 1000 N. Lake Shore Dr. #9, Chicago, Ill. 60611

[21] Appl. No.: 884,912

[22] Filed: Mar. 9, 1978

[51] Int. Cl.[2] ..... A63H 33/10

[52] U.S. Cl. ..... 46/17; 46/26; 46/29; 46/31; 220/4 F

[58] Field of Search ..... 46/16–31; 35/27; 220/23.4, 4 B, 4 E, 4 F; 40/155

[56] References Cited

U.S. PATENT DOCUMENTS

| | | | |
|---|---|---|---|
| 2,170,771 | 8/1939 | Benjamin | 46/29 |
| 2,712,447 | 7/1955 | Steinhardt | 46/17 X |
| 2,885,822 | 5/1959 | Onanian | 46/29 X |
| 3,205,611 | 9/1965 | Onanian | 46/16 X |
| 3,450,293 | 6/1969 | Seda et al. | 220/4 F |
| 3,698,123 | 10/1972 | Heldt | 46/29 |
| 3,780,469 | 12/1973 | Hancovsky | 46/25 |
| 3,921,312 | 11/1975 | Fuller | 46/23 |
| 3,975,858 | 8/1976 | Much | 46/26 |
| 3,987,579 | 10/1976 | Palenik | 46/16 |
| 4,099,887 | 7/1978 | Mackenroth | 46/28 X |

FOREIGN PATENT DOCUMENTS

| | | | |
|---|---|---|---|
| 1401015 | 4/1965 | France | 46/31 |

*Primary Examiner*—John F. Pitrelli

*Attorney, Agent, or Firm*—Dressler, Goldsmith, Clement, Gordon & Shore, Ltd.

[57] ABSTRACT

A toy construction kit is provided which includes, as basic building elements, a plurality of interlockable plate members, each plate member having a tongue along one side and a groove along the other side whereby two or more plate members can be connected together in tongue and groove fashion to form a composite structural member with the preferred composite structural member being a hollow polyhedron such as a right rectangular prism. The plate members have apertures for receiving dowel members which have a slot extending along their length so that each dowel member may be force-inserted into one of the apertures for being compressively retained therein. The dowel members also have keyhole-shaped apertures on each end for receiving flat panel members and lock pins. Disc-shaped hubs, wheels and angle blocks are provided for being carried by the dowel members. The angle blocks are provided with projecting pins for being received in the apertures of the plate members. The angle block further has a central aperture for receiving a dowel member and has a keyhole-shaped aperture in each projecting pin. The lock pin may be received in the keyhole-shaped aperture of the angle block projecting pin as well as in the keyhole-shaped aperture of the dowel members.

21 Claims, 26 Drawing Figures

214
86
88
212
90
80
82
92
210
84
94
96

228
220
222
230
224
228
232
220
228

232
224
230
232
228
228
230
220

38
30
38
228
224

250
248
250
250

260

266
264
268

272
276
275
274
274
276
272
277
275
275
270
274
276
272

284
282
280

288
286

TOY CONSTRUCTION KIT

BACKGROUND OF THE INVENTION

This invention relates to improved toy construction elements and to assemblies fabricated with such elements.

A wide variety of construction element or building block systems have been developed over the years. A number of such systems provide generally solid, right rectangular blocks defining a plurality of circular holes and/or grooves for receiving connecting rods. Such systems are disclosed in the U.S. Pat. Nos. 1,308,254, 2,482,402 and 2,493,435. Other systems provide generally solid, right rectangular blocks with a plurality of holes or apertures therein for receiving, in compressive engagement, connecting dowel pins which may be made of resilient material and/or have longitudinally extending grooves to allow flexing of a portion of the dowel pin which is inserted into the block aperture. Systems such as these are disclosed in the U.S. Pat. Nos. 1,142,471; 1,216,840; 2,093,341; 2,100,658; 2,225,612; 2,320,292; 2,709,318; 3,603,026; 3,672,681; and British Pat. No. 214,821. Another system, using generally solid, cylindrical elements is disclosed in the U.S. Pat. No. 2,662,335.

The inventor of the present invention has been issued U.S. Pat. No. 3,975,858. The patent discloses improved, solid fabricating members having a plurality of bores for receiving connecting rods.

The French Pat. No. 1,246,185 and the U.S. Pat. No. 3,360,883 disclose construction elements having elongated slots with intercepting bores for grippingly receiving complimentary members.

Generally solid construction blocks, such as those disclosed in the above-discussed patents, inherently suffer from a number of disadvantages. First, a solid block requires more material than a hollow block. Thus, the material cost for a solid block is greater than the material cost for a non-solid or hollow block. Second, a solid block, if molded from a thermoplastic material, requires a longer cooling or setting time during manufacture compared to a thin walled hollow block. With a shorter setting time for a hollow block, production rates can be increased. This results in less cost per unit produced owing to the decrease in chargeable molding time. Third, a solid block is obviously heavier than a hollow block of the same size. When solid blocks are used for large constructions involving relatively great heights or span lengths, this additional weight is disadvantageous in that it can cause a tipping or sagging of the structure or even a loosening of the particular connecting means joining the blocks. Thus, it would be desirable to provide a non-solid or substantially hollow construction element or block which would not have such disadvantages.

It would be beneficial to provide substantially plate-like or flat construction elements which could be assembled to form three-dimensional structural elements or blocks. This would have a number of advantages. First, packaging and shipping costs would be reduced since the package could be made considerably smaller owing to the fact that the entire toy construction kit could be shipped with the basic building blocks disassembled as separate flat members. Second, use of individual flat members to construct three-dimensional building blocks would allow the blocks to be made of various sizes. This is something that is not possible with building block assemblies of the type disclosed in the above-listed patents where the basic building block is of a predetermined size. Third, the various flat structural members could be of different colors thereby allowing the construction of three-dimensional structural building blocks having sides of different colors.

It would be helpful, in providing a toy construction kit wherein basic building blocks are formed from flat structural members, to incorporate a tongue and groove design which would automatically align the separate flat members in an appropriate orientation for forming the three-dimensional composite structural member or building block.

SUMMARY OF THE INVENTION

In accordance with this invention, toy construction elements are provided for forming basic composite structural members or blocks and for connecting or joining those members in face-to-face or spaced-apart relationship. Further, additional construction elements are provided, such as wheel members and hub members, which can be carried by or mounted on the connecting members The plate members can be easily assembled with a tongue and groove connection to form generally hollow building blocks. Depending on the specific shape of the individual plate members, the composite structural members or building blocks may have a rectangular cross section, a triangular cross section, a circular cross section, or other cross section. The composite structural members or building blocks can be of any desired length by staggering or offsetting the adjacent, interconnected plate members. Holes are provided in the plate members for receiving the connecting pins or dowel members. The use of generally flat planar members to form three-dimensional composite structural members or blocks reduces the amount of material required, compared to a solid structural member or block, and consequently reduces the weight of the composite structural member.

Thus, it is seen that the combined effect of the various elements associated in accordance with the present invention is not merely equal to the sum of the several effects of those elements alone. Rather, the novel combination of elements in accordance with the present invention yields a desirable and synergistic result—a result which is a substantial improvement over the prior art.

Numerous other advantages and features of the present invention will become readily apparent from the following detailed description of the invention and embodiments thereof, from the claims and from the accompanying drawings.

BREIF DESCRIPTION OF THE DRAWINGS

In the accompanying drawings forming part of the specification, and in which like numerals are employed to designate like parts throughout the same, FIG. 1 is a perspective view of a plate member of the present invention;

DESCRIPTION OF THE PREFERRED EMBODIMENT

Figure 1:
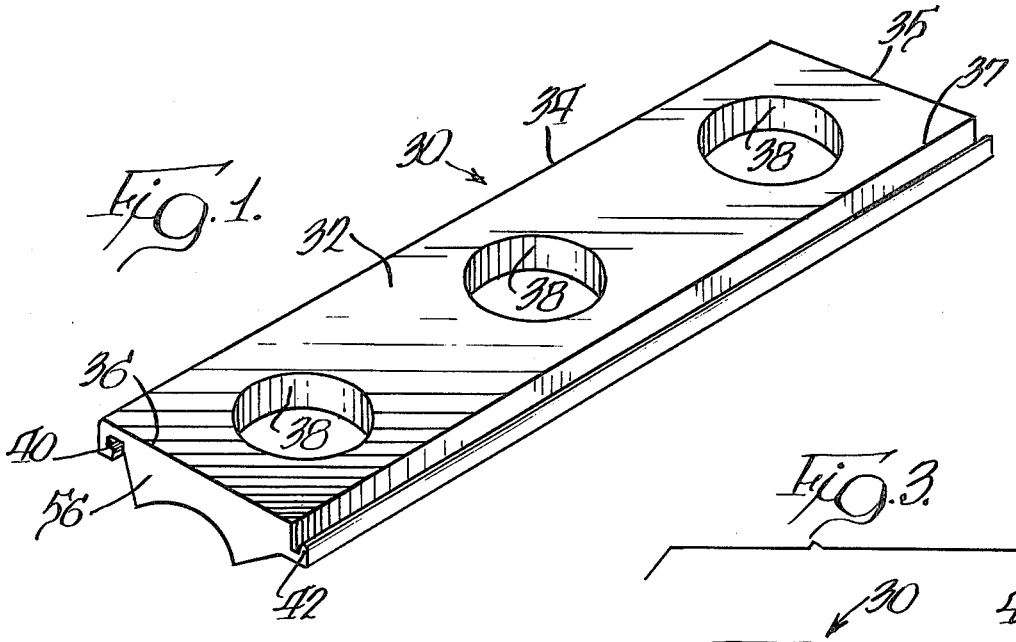

While this invention is susceptible of embodiment in many different forms, there are shown in the drawings and will herein be described in detail preferred embodiments of the invention. It should be understood, however, that the present disclosure is to be considered as an exemplification of the principles of the invention and is not intended to limit the invention to the embodiments illustrated.

The precise shapes and sizes of the components herein described are not essential to the invention unless otherwise indicated, since the invention is described with only reference to embodiments which are simple and straight-forward.

Figure 2:
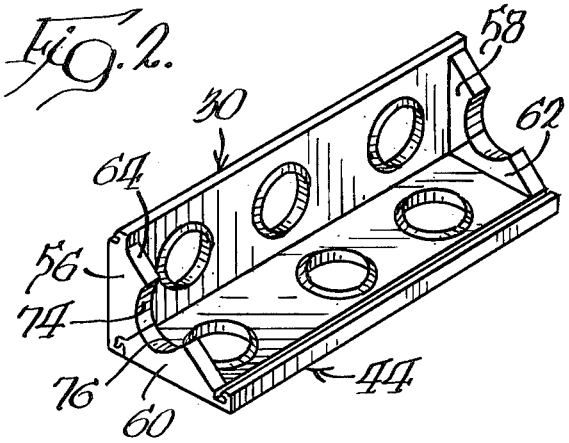
FIG. 2 is a perspective view of two plate members of the present invention joined together along their respective edges.
Figure 4:
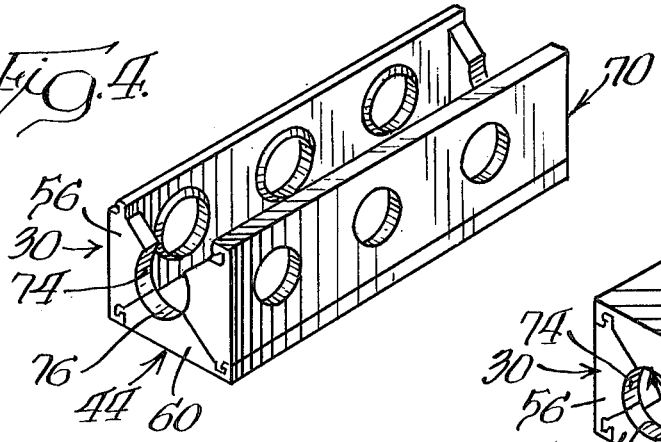
FIG. 4 is a perspective view similar to FIG. 2 but showing a third plate member connected with two other plate members to form a generally U-shaped channel composite structural member.
Figure 5:
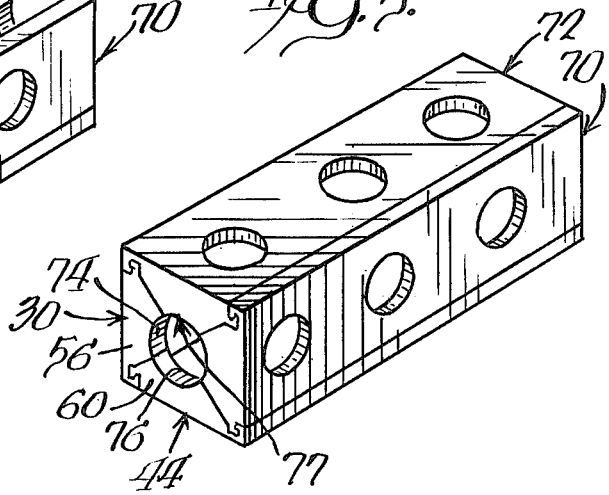
FIG. 5 is a perspective view similar to FIG. 4 but showing a fourth plate member connected to the three other plate members to form a generally hollow right rectangular prism composite structural member.

Referring now to the drawings, FIG. 1 illustrates a basic interlockable plate construction member 30 in accordance with the present invention. The plate member 30 has two major side surfaces, one of these side surfaces designated 32 in FIG. 1 and the other side surface not visible in FIG. 1 but oppositely facing from side surface 32. The plate member illustrated in FIG. 1 is generally planar and rectangular in shape and is defined by four sides or edges 34 through 37. The plate member 30 defines a longitudinal groove 40 extending along side or edge 34 and an outwardly projecting longitudinally extending tongue 42 along the opposite side or edge 37. The plate 30 may be joined together with one, two or three other similar plate members through the tongue and groove structures as illustrated in FIGS. 2, 4, and 5, respectively, and as will be explained in more detail hereinafter.

With reference again to FIG. 1, the planar member 30 preferably also has one or more circular apertures 38 for receiving other circular-shaped constructions or structural members in accordance with the present invention, which other members will be described in detail hereinafter.

The tongue and groove structure is adapted to form a "snap fit" connection. In general, snap fit connections are well known in the art and involve a mechanical and friction interlocking of one piece within another piece. In the typical snap fit construction, the snap fit, during the assembly process, undergoes an energy exchange which usually produces a "click" sound. Once assembled, the components are not under load and the pull out strength of the snap fit can be made hundreds of times larger than the required "snap-in" force.

Snap fits are widely used in the plastic industry and the snap fit connnection portions of the structural members of the present invention are preferably made of plastic which can tolerate a relatively large strain at the elastic limit and which has a low elastic modulus.

The fact that the snap fit, once assembled, is not under load, is an advantage over other types of connections, such as many of those disclosed in the above-listed patents in the Background of the Invention, in that it is not constantly under stress resulting from the assembly process and thus, over a long period of time, does not suffer stress relaxation and creep which can cause failure of common press fit type connections.

Figure 3:
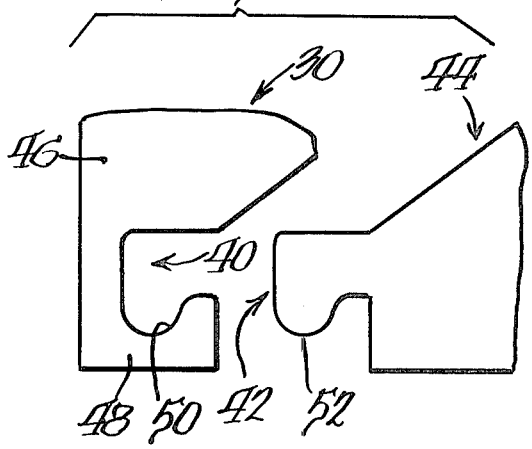
FIG. 3 is an enlarged, fragmentary and view of two plate members of the present invention shown spaced apart to illustrate in detail the tongue and groove connection structure.

The preferred form of the tongue and groove snap fit connection is best illustrated in FIGS. 2 and 3. In FIG. 2, plate member 30 of FIG. 1 is shown connected to an identical plate member 44. In FIG. 3, the plate members 30 and 44 are shown spaced apart, just prior to making the tongue and groove snap fit. The groove 40 is seen to be formed in resilient wall portions 46 and 48 of plate member 30 which define an enlarged, undercut region 50 as part of the groove. The tongue 42 of plate member 44 has an enlarged cantilever portion 52 on the distal end for being received in the undercut region 50 of the groove 40 of plate member 30. During assembly, the tongue 42 is pushed against the opening of groove 40 and the resilient wall portions 46 and 48 are deformed sufficiently to allow insertion of the tongue 42. Some deformation of the tongue 42 may also occur. However, after the cantilever portion 52 has become seated within the undercut region 50 of the groove 40, the forces causing deformation are no longer present and the tongue and groove structures return, owing to the elasticity of the material, to their original shapes.

When the assembled snap fit connection is to be taken apart, a procedure is followed which is basically the reverse of that described above for the assembly process. The tongue and groove structures deform as necessary to permit disengagement when a great enough pull force is applied to the two plate members. It also helps during disengagement if one of the plate members is twisted or rotated along the tongue and groove structure relative to the other.

In FIG. 2, the two plate members 30 and 44 are joined in a snap fit with the plate members interlocked at right angles to each other to form a composite structural member in the form of a so-called angle. To provide for increased structural integrity of the snap fit connection and of the composite structural member formed between two or more plate members, such as members 30 and 44 in FIG. 2, a novel abutment structure is preferably used. Specifically, with reference to FIG. 2, it is seen that plate member 30 has an abutment end wall 56 at one end and an abutment end wall 58 at the other end. Likewise, plate member 44 has similar abutment end walls 60 and 62. Each end wall has two slanted surfaces, such as surface 64 designated on end wall 56, which angle inwardly from the longitudinal edges of the plate member at a 45 degree angle to provide a reinforcing abutment against the identical end wall of the other similar plate member when the two plate members are each in side-to-side tongue and groove snap fit engagement.

Three plate members can be connected to form a U-shaped channel composite structural member as illustrated in FIG. 4 where a third plate member 70 is shown connected to the angle composite structural member formed by plate members 30 and 44. If a fourth plate member, such as plate member 72 shown in FIG. 5, is connected between plate members 30 and 70, then a composite structural member results which has the shape of a right rectangular prism. With the composite structural prism thus formed, the apertures in the plate members are so oriented that apertures on opposite pairs of walls or plate members are coaxial to thus allow the admission of cylindrical structural members as will be explained in detail hereinafter.

FIG. 5 also illustrates another novel feature of the present invention. Specifically, the end walls of each of the plate members define, at the distal end thereof, a 90 degree circular surface, such as surfaces 74 and 76, for end walls 56 and 60, respectively, so that when the four similar plate members are in side-to-side tongue and groove engagement to form the right rectangular prism, a circular aperture 77 is formed in each of the two opposed end faces of the prism with the center of the circular aperture 77 being equidistant from all corners of the face. These apertures are, as is the case with the individual apertures 38 of each plate member, adapted to receive therein cylindrical structural members as will be described in detail hereinafter.

Figures 6, 7, 8, 9, 10, 11, 12, 13, 14, 15:
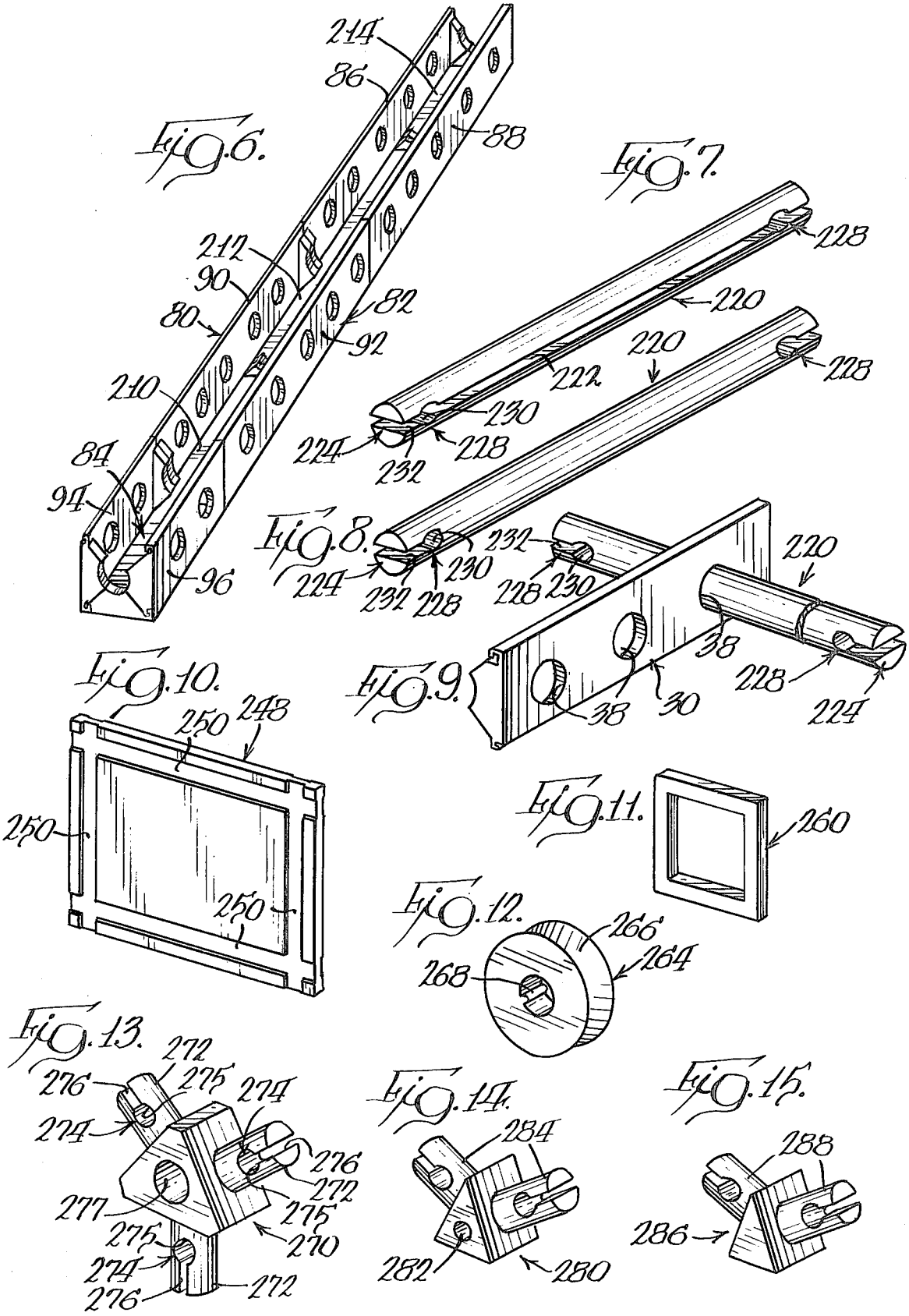
FIG. 6 is a view similar to FIG. 4 but showing a plurality of plate members interlocked end to end in staggered relationship to illustrate the fabrication of an elongated U-shaped composite structural member.
FIG. 7 is a perspective view of a cylindrical dowel member of the present invention.
FIG. 8 is a perspective view of the cylindrical dowel member illustrated in FIG. 7 but rotated 180 degrees about the longitudinal axis.
FIG. 9 is perspective view of the dowel member illustrated in FIGS. 7 and 8 inserted in an aperture of the plate member of FIG. 1.
FIG. 10 is a perspective view of a flat polygonal-shaped panel member in accordance with the present invention.
FIG. 11 is a view of a rectangular frame assembly in accordance with the present invention.
FIG. 12 is a perspective view of a disc-shaped pulley or wheel in accordance with the present invention.
FIG. 13 is a perspective view of an angle block connector element in accordance with the present invention.
FIG. 14 is a perspective view of second type of angle block connector element in accordance with the present invention.
FIG. 15 is a perspective vew of a third type of angle block element in accordance with the present invention.

When four equal length plate members are assembled to form a right rectangular prism as illustrated in FIG. 5, the length of the prism necessarily equals the length of the individual plate members. However, according to the present invention, it is possible to form composite structural members which are longer than the individual plate members by staggering the lengths of each plate member relative to the other plate members as illustrated in FIG. 6. FIG. 6 shows a U-shaped channel composite structural member having upstanding sidewalls 80 and 82 and a bottom wall 84. The sidewalls 80 and 82 are formed from opposed pairs of individual plate members 86 and 88, 90 and 92, and 94 and 96. Members 94 and 96 are shorter than members 86, 88, 90 and 92. The plate members forming the sidewalls 80 and 82 are connected to plate members 210, 212, and 214 which form the bottom of the channel. The abutting ends of bottom channel plate member pair 210 and 212 and of pair 212 and 214 are seen to be located midway between the abutting ends of the plate members forming the sidewalls 80 and 82. Also, it is seen that the bottom plate member 214 is shorter than the other two bottom plate members 212 and 210 and, specifically, is equal in length to the short side plate members 94 and 96 so that the bottom and side plate members at each end of the composite channel terminate at the same point to form a straight channel end. It can be seen that a right rectangular prism can be formed from the channel illustrated in FIG. 6 by connecting thereto three more plate members similar to, and facing, the channel bottom plate members 210, 212 and 214. In this manner, a composite structural member can be made as long as is desired.

FIGS. 7 and 8 illustrate a cylindrical dowel member 220 in accordance with the present invention which can be inserted and compressively retained in one of the apertures 38 of plate member 30 as illustrated in FIG. 9. As illustrated in FIG. 7, the dowel member is a substantially solid cylinder, preferably formed of a resilient plastic material, which has a longitudinally extending slot 222 therein. The slot does not extend entirely through the dowel member 220 but preferably extends one half of the diameter of the dowel member 220. The dowel member has two end faces, such as face 224, visible in FIGS. 7 through 9, which are normal to the longitudinal axis of the dowel. The dowel further has a keyhole shaped aperture 228 aligned with the diameter of the dowel, which aperture 228 has a generally cylindrical bore 230 and a generally right rectangular prism-shaped slot 232 communicating with the cylindrical bore 230 on one end of the slot and with the dowel end face 224 on the other end of the slot. The keyhole shaped aperture 228 is adapted to receive a locking pin type of structural element which will be described in detail hereinafter.

The longitudinally extending slot 222 in the dowel member 220 allows the dowel member 220 to be deformed, as by compression to decrease the width of the slot 222, to permit the dowel member 220 to be inserted within an aperture, such as aperture 38 of plate member 30 as illustrated in FIG. 9.

Figure 22:
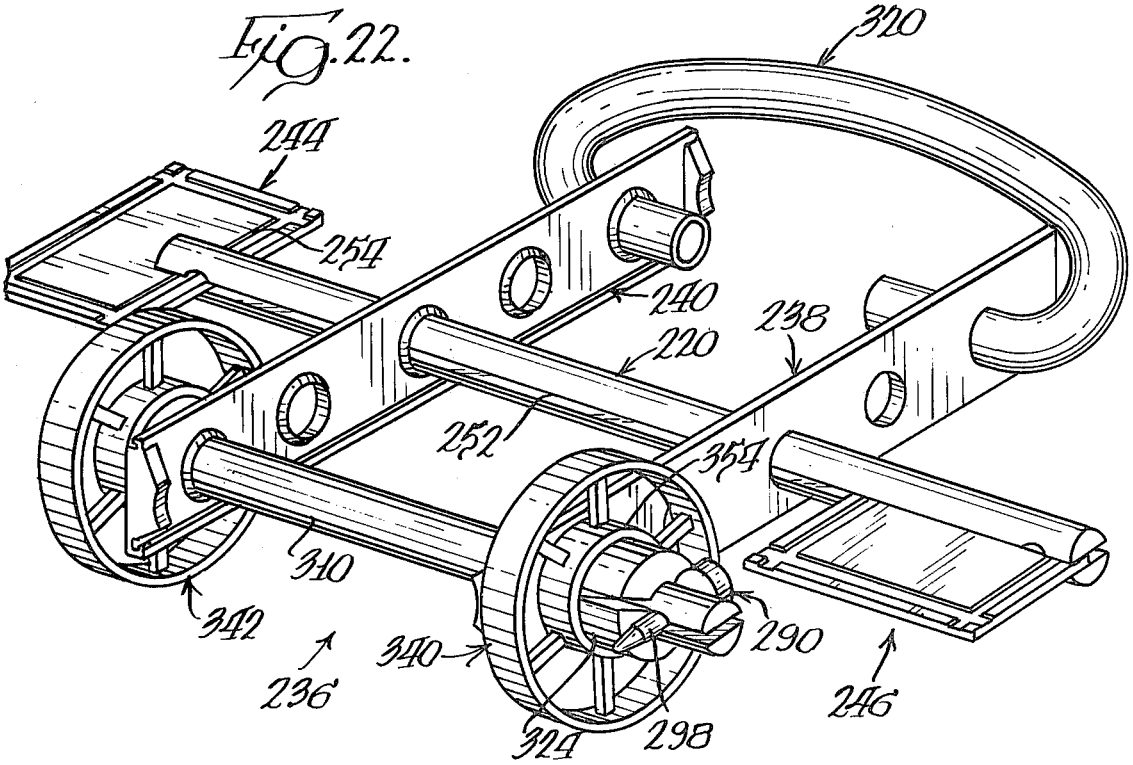
FIG. 22 shows a plurality of structural members of the present invention joined together to form a toy assemblage.

The dowel member can be carried by one or more plate members such as in the toy assemblage 236 illustrated in FIG. 22. The toy assemblage 236 is seen to have two spaced-apart parallel plate members 238 and 240, both similar to plate member 30 illustrated in FIG. 1, which together carry the dowel member 220.

The dowel member 220 is adapted to receive other structural members which comprise a toy construction kit of the present invention. Such structural members can include a panel member, such as panel members 244 and 246, shown connected to the dowel member 220 as part of the toy assemblage in FIG. 22.

The detailed construction of a panel member is best shown with reference to the enlarged view in FIG. 10 of a panel member 248 which is identical to panel members 244 and 246 shown in FIG. 22 and discussed above. The panel member 248 is a generally flat, polygonal-shaped member, in this case, a rectangular-shaped member, having single channels 250 parallel to and spaced inwardly of each side edge.

With reference to FIG. 22, it can be seen that a panel member, such as panel member 246, can be inserted into the longitudinal slot 252 of the dowel member 220. Alternatively, a panel member, such as panel member 244 in FIG. 22, can be inserted into the keyhole-shaped aperture at the end of the dowel member 220 wherein the end portion of the dowel member 220 is compressively engaged with the channel 254 of the panel 244.

A frame member 260 is illustrated in FIG. 11. The frame member 260 is a generally rectangular or square-shaped piece with an interior rectangular or square-shaped aperture. The frame member 260 may be inserted over a square-shaped composite structural member, such as the right rectangular prism composite structural member illustrated in FIG. 5. This is useful, in certain instances, for reinforcing the composite structural member and for preventing the sides or plate members which form the composite structural member from being forced apart when excessive pressure is exerted on those plate members, for example by dowel members inserted in the plate member apertures.

FIG. 12 illustrates a disc, hub or pulley 264 which can be inserted on an axle member discussed hereinafter. The pulley 264 has a U- or V-shaped groove 266 on its periphery for receiving cords or V belts. The pulley also has a key 268 which can be received by a suitable channel in an axle member, as will be explained in detail hereinafter, for preventing rotation of the pulley 264 relative thereto.

FIGS. 13, 14, and 15 illustrate angle block members 270, 280, and 286, respectively, which may be used to connect the basic plate members or composite structural members together at non-right angles.

With reference to FIG. 13, it is seen that an angle block 270 has a shape of a substantially regular triangular prism having five major faces. Cylindrical dowel pins 272 project from three of the five faces and each define, in the distal end, a keyhole-shaped aperture 274 having a generally cylindrical bore 272 and a generally right rectangular prism-shaped slot 276 communicating with the cylindrical bore 275 on one end of the slot and with the distal end of the dowel pin on the other end of the slot—essentially the same configuration described in detail with respect to the keyhole-shaped slots 228 of the dowel pin 220 illustrated in FIGS. 7–9. The angle block 270 also preferably has a central cylindrical bore 277 oriented along the longitudinal axis parallel to three of the five faces and perpendicular to the remaining two faces.

The angle block 280 illustrated in FIG. 14 is similar to angle block 270 illustrated in FIG. 13 except that, whereas the angle block 270 in FIG. 13 is illustrated as a regular triangular prism, the angle block 280 illustrated in FIG. 14 has a cross section in the shape of an isosceles triangle. A central aperture 282 is provided in the angle block 280 but is smaller than the bore 277 in the angle block illustrated in FIG. 13. Like the angle block 270 illustrated in FIG. 13, the angle block 280 in FIG. 14 has dowel pins, such as dowel pins 284. Though only two dowel pins 284 are shown as projecting from the angle block 280, a third dowel pin could be provided if desired.

The angle block 286 shown in FIG. 15 is similar to the angle block 280 illustrated in FIG. 14. However, the angle block 286 in FIG. 15 has a shorter base (with respect to the isosceles triangle cross section) and a smaller vertex angle than the angle block 280 illustrated in FIG. 14. Further, angle block 286 has no central aperture. The angle block 286 does have dowel pins 288, similar to the dowel pins 284 of angle block 280 illustrated in FIG. 14.

In addition to the fact that the dowel pins in the angle blocks can be inserted in the apertures of a plate member, such as apertures 38 of plate member 30 in FIG. 1, other structural members comprising the toy construction kit of the present invention can be secured to the dowel pins of the angle blocks. For example, the panel 248 illustrated in FIG. 10 could be held in the end of one of the dowel pins in the same manner that the panel member 244 is held in the end of the dowel member 220 in FIG. 22.

Figure 16:
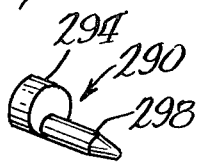
FIG. 16 is a perspective view of a lock pin in accordance with the present invention.
Figure 17:
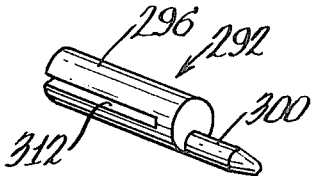
FIG. 17 is a perspective view of a second type of lock pin in accordance with the present invention.

FIGS. 16 and 17 illustrate lock pins 290 and 292 which can be inserted into the cylindrical bore of the keyhole-shaped aperture of a dowel member, such as dowel member 220 illustrated in FIG. 7, or of an angle block dowel pin, such as pin 272 in FIG. 13.

Lock pins 290 and 292 comprise a generally elongate first cylindrical member 294 and 296 respectively, and a generally elongate second cylindrical member 298 and 300, respectively. The first and second elongate members are joined end-to-end as illustrated with their axes parallel. The diameter of each of the second elongate members 298 and 300 is less than the diameter of the respective first elongate members 294 and 296 but is slightly greater than the cylindrical bore of the keyhole-shaped apertures defined in the dowel members (e.g., dowel member 220 illustrated in FIGS. 7–9) and in the dowel pins of the angle blocks (e.g., pins 272, 284, and 288 of angle blocks 270, 280 and 286, respectively, illustrated in FIGS. 13, 14, and 15, respectively). Thus, the second elongate cylindrical members, 298 and 300, can be force-inserted into the cylindrical bore of the keyhole-shaped apertures of the dowel members or dowel pins for being compressively retained therein. This is illustrated in the toy assemblage shown in FIG. 22 wherein lock pin 290 is shown engaged with a dowel member 310. Since the second elongate member 298 of the lock pin 290 is slightly larger than the cylindrical bore of the keyhole-shaped aperture of the dowel member 310, the end of the dowel member 310 is slightly expanded to receive the lock pin 290 and the lock pin 290 is held in compressive engagement therewith. The lock pin prevents other structural components which may be rotatably disposed on the dowel member 310 from sliding off of the end of the dowel pin.

With reference now to FIG. 17, it can be seen that the lock pin 292 further has a generally right rectangular, prism-shaped slot 312 extending for at least a portion of the length of the first member 296 and communicating with the distal end thereof opposite the second member 300 whereby the first member 296 may be force-inserted into one of the apertures of the planar members (e.g., aperture 38 of member 30 in FIG. 1) for being compressively retained therein.

It should be noted that both lock pins 290 and 292, illustrated in FIGS. 16 and 17, respectively, have the longitudinal axes of the first and second members parallel but offset with respect to each other. Preferably, the second member (298 or 300) is disposed relative to the first member (294 or 296) so that the exterior circular surface of each first and second cylindrical member is tangent at one point. The lock pins can then be rotated, about the central longitudinal axis of the second cylindrical member, to force a portion of the exterior surface of the first cylindrical member tight against an adjacent structural member if desired. FIG. 22 illustrates this for lock pin 290.

The distal ends of the second cylindrical members (298 or 300) of the lock pins are preferably tapered to accommodate insertion of the second members into the cylindrical bore of the keyhole-shaped aperture of the dowel members. Likewise, the distal end of the first cylindrical member of pin 292 may be slightly tapered to accommodate initial insertion of the first member into the apertures of the plate members.

Figure 18:
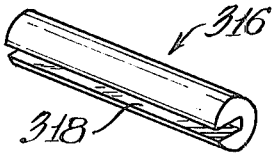
FIG. 18 is a perspective view of an axle in accordance with the present invention.

FIG. 18 illustrates an axle member 316. The diameter of the axle member 316 may be slightly less than the diameter of the dowel members (e.g., dowel member 220 illustrated in FIGS. 7 through 9) and may be slightly less than the diameter of the plate member apertures (e.g., such as the apertures 38 of plate member 30 illustrated in FIG. 1). The axle 316 can also have a longitudinally extending slot 318 which allows the axle to receive keyed discs or pulleys. Though not illustrated in FIG. 18, the axle may also have a keyhole-shaped aperture on either or both ends similar to the keyhole-shaped aperture 228 provided in the dowel 220 illustrated in FIGS. 7, 8, and 9 and described above. The keyhole-shaped aperture may be used to receive a panel member (such as panel member 244 illustrated in FIGS. 10 and 22) or a lock pin (such as lock pin 290 illustrated in FIGS. 16 and 22).

When a pulley, such as pulley 264 illustrated in FIG. 12, is mounted on the axle 316, the key 268 of the pulley 264 is received within the longitudinally extending slot 318 to prevent rotation of the pulley relative to the axle 316. (The pulley or disc 264 might also be fabricated for mounting in a similar manner to a dowel member, such as dowel member 220 illustrated in FIGS. 7–9).

Figure 19:
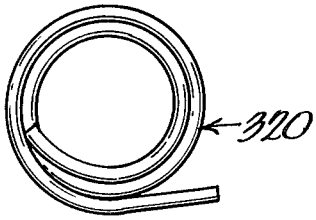
FIG. 19 is a top plan view of a coil of flexible tubing in accordance with the present invention.

FIG. 19 illustrates flexible tubing 320 having a diameter slightly larger than the plate member apertures (e.g., such as apertures 38 of plate member 30 illustrated in FIG. 1), whereby the flexible tubing 320 can be inserted into the plate member apertures and compressively retained therein as illustrated in FIG. 22. The flexible tubing is particularly useful in creating artistic flower designs, arches, animal representations, and mobiles.

Figure 20:
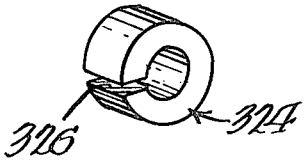
FIG. 20 is a perspective view of a hub in accordance with the present invention.

A hub 324 is illustrated in FIG. 20. The hub is a generally cylindrical or annular member having a slot 326 to allow expansion of the hub to accommodate placement on a dowel member, such as dowel member 220 illustrated in FIGS. 7–9, or on an axle, such as axle 316 illustrated in FIG. 18. The hub 324 is illustrated in the toy assemblage in FIG. 22 mounted on a dowel member 310 to act as a spacer.

Figure 21:
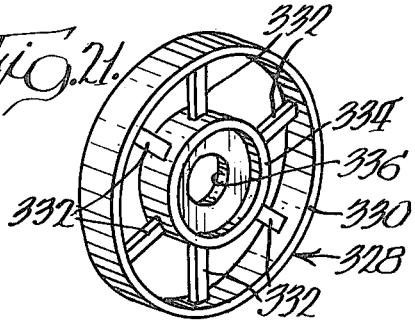
FIG. 21 is a perspective view of a wheel in accordance with the present invention.

FIG. 21 illustrates a wheel 328 having a circumferential annulus or cylinder portion 330, a plurality of spokes 332, and a central hub 334. The hub defines a central mounting aperture 336, the diameter of which aperture 336 is greater than the diameter of the dowel members and axles so that the wheels can be mounted on the dowel members or axles and can turn freely thereon.

Two wheels, 340 and 342, which are identical to wheel 328 illustrated in FIG. 21, are shown as part of the toy assemblage in FIG. 22. Wheel 340 is mounted on dowel member 310 and is disposed between plate member 238 and hub 324. Wheel 342 is similarly mounted on the other end of dowel member 310. With reference to wheel 340, it can be seen that the hub 324 is received in a close fitting relationship with the hub portion 354 of the wheel 340.

Figure 23:
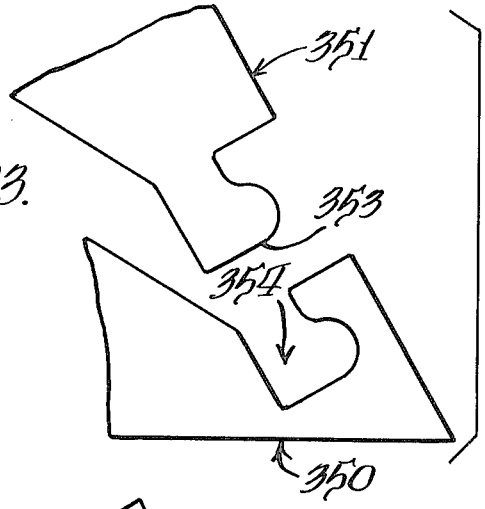
FIG. 23 is an enlarged fragmentary end view of two plate members similar to FIG. 3 but showing a tongue and groove structure for plate members adapted to form a composite structural member having a triangular cross section.
Figure 24:
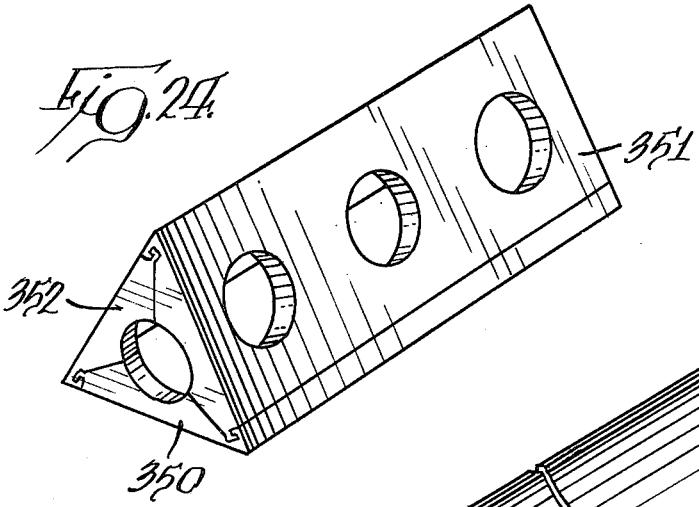
FIG. 24 is a perspective view of a composite structural member having the general shape of a regular triangular prism.

FIGS. 23 and 24 illustrate another embodiment of the planar or plate members of the present invention. Three plate members 350, 351, and 352 are illustrated in FIG. 24 as forming a generally regular triangular prism having a hollow interior. Each plate member is similar to the plate member 80 previously described with reference to FIG. 1. However, since the plate members form a triangular composite structural shape, the plane of each plate member is at an acute angle with respect to the planes of the other plate members when the composite is formed. Consequently, the tongue and groove structure must be oriented at the appropriate angle to accommodate proper joining of the plate members.

FIG. 23 illustrates the proper orientation of the tongue and groove structures. The tongue 353 projects essentially outwardly from the plate member in the plane of the member 351. The groove 354 is necessarily oriented within the plate member 350 at the proper acute angle associated with the triangular prismatic shape of the composite structure—in this case, for an equilateral triangular prism—at a 60 degree angle with respect to the plane of the plate member.

Figure 25:
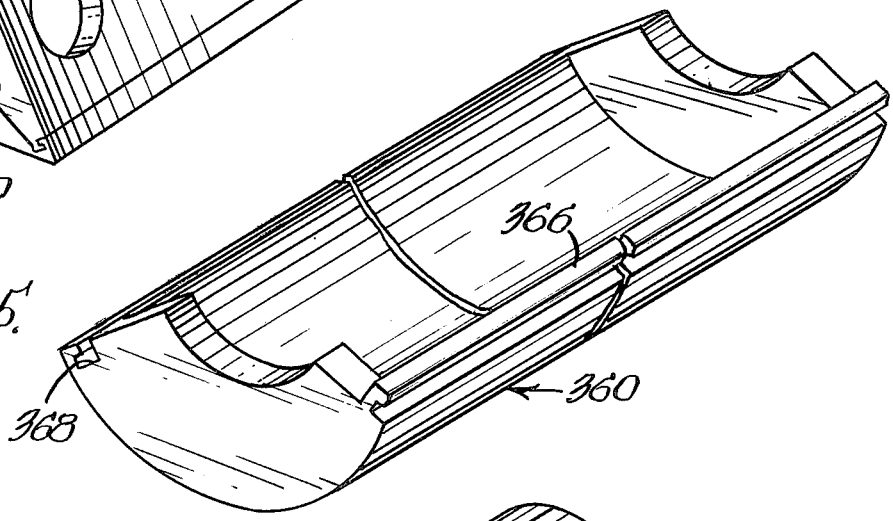
FIG. 25 is a perspective view of another type of plate member of the present invention, which plate member conprises an arcuate portion of a hollow cylinder.
Figure 26:
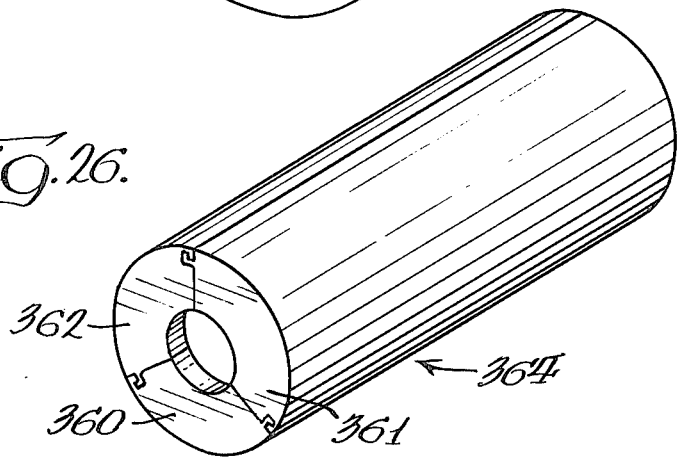
FIG. 26 is a perspective view of a composite structural member formed from three structural members like the one disclosed in FIG. 25, which composite structural member has the shape of a generally right circular cylinder.

FIG. 25 illustrates another embodiment of a plate member 360 which may be used, with other similar plate members, to form a composite structural member having a shape of a hollow right cylinder, such as the cylinder 364 illustrated in FIG. 26 as being formed from three plate members 360, 361, and 362. The plate member 360 illustrated in FIG. 5 is similar to the flat, planar plate member 30 illustrated in FIG. 1, except that it is curved to form a section or wall of a cylinder. Like the plate member 30 illustrated in FIG. 1, the curved arcuate plate member 360 has a tongue 366 and groove 368 along opposite side edges. The tongue and grooves are suitably oriented so that the tongue of one arcuate plate member may be interlocked in a snap fit with the groove of another similar arcuate plate member in substantially the same manner as was described for the connection between the flat, planar plate members described heretofore with references to FIGS. 1 through 5. Although the arcuate plate members 360, 361, and 362 are illustrated in FIG. 26 as not having any apertures (such as apertures 38 for plate member 30 illustrated in FIG. 1), apertures could obviously be provided to accommodate the insertion of dowel members and other similar structural elements or members.

Although the composite cylindrical element or member 364 illustrated in FIG. 26 is shown to be comprised of three separate arcuate plate members, it is to be noted that any number of such arcuate members (two or more) could be used to form the composite cylindrical member. If apertures are to be provided for receiving dowel pins, it would be desirable to provide an even number of arcuate elements for forming a composite structural cylindrical member so that pairs of apertures 180 degrees apart on the circumference of the composite cylindrical member would be in alignment for receiving dowel pins therethrough.

The plate members, such as plate member 30 illustrated in FIG. 1, have been described as having circular apertures, such as apertures 38, for receiving cylindrical dowel members and axle members. However, some or all of the plate member apertures may be non-circular, such as square or rectangular, for receiving non-circular cross section connecting members (not illustrated). Also, the cylindrical dowel member 220 could be inserted into a square-shaped aperture if the length of each side of the square aperture were equal to, or were just slightly less than, the diameter of the dowel.

Not all plate members 30 need have a plurality of apertures 38. Some plate members may not have any apertures or may have only one aperture. Such plates are useful in forming structural members wherein one or more sides are substantially closed.

Although the plate members, such as plate member 30 illustrated in FIG. 1, plate member 350 illustrated in FIG. 24, and plate member 360 illustrated in FIG. 25, all preferably have a resilient, snap-fit tongue and groove structure, it is to be understood that the connection between adjacent plate members could be provided without requiring a snap-fit type connection. That is, with the tongue and groove structure identical to or similar to that described with reference to FIG. 3, a non-resilient material could be used that would be incompatible with a snap-fit connection but that would still permit the connection to be made by first aligning the two plate members to be connected in end-to-end relationship and then sliding the tongue portion into the groove portion.

In addition to the structural members so far described, other similar members can be used with one or more of the structural members described. For example, winches, hooks and cranks, flexible cords, etc., can be adapted, by appropriate design, to be mounted within the plate member apertures or on the dowel members or dowel pins. There are many other such structures which can be adapted to be used with the novel basic structural elements of the present invention that have been thus far described.

From the foregoing, it will be observed that numerous variations and modifications may be effected without departing from the true spirit and scope of the novel concept of the invention. It is to be understood that no limitation with respect to the specific apparatus illustrated herein is intended or should be inferred. It is, of course, intended to cover by the appended claims all such modifications as fall within the scope of the claims.

I claim:

1. A toy construction kit comprising:

a plurality of interlockable thin wall members adapted to form composite, hollow structural members, each wall member having two major side surfaces defined by two opposed end edges and two opposed longitudinal edges, one of said major side surfaces being an interior surface and one of said major side surfaces being an exterior surface in the formed composite hollow structural member, each wall member having two spaced apart, resilient wall portions defining therebetween a longitudinal groove extending along one edge of the wall member and each wall member further having a longitudinal tongue extending along the other edge, said tongue projecting outwardly from the edge of said wall member, said groove being adapted to matingly receive the tongue of another similar wall member in a snap fit when the wall members are interlocked along the side edges, each thin wall member further including an end wall at each end of the thin wall member projecting from said interior surface, said end wall having two slanted surfaces angled inwardly from the two longitudinal edges of said wall member to provide a reinforcing abutment against identical end walls of two other similar wall members when said two other wall members are each in side-to-side tongue and groove snap fit engagement with said one wall member.

2. The toy construction kit in accordance with claim 1 in which said wall portions define an enlarged, undercut region of said groove and in which said tongue has an enlarged cantilever portion on the distal end for being received in said undercut region of said groove.

3. The toy construction kit in accordance with claim 1 in which at least one said wall member is planar and has an end wall at each end projecting from, and normal to, the planar member, said end wall having two slanted surfaces angled inwardly from the two longitudinal edges of said planar member at a 45 degree angle to provide a reinforcing abutment against identical end walls of two other similar planar members when said two other planar members are each in side-to-side tongue and groove snap fit engagement with said one planar member.

4. The toy construction kit in accordance with claim 3 in which said end wall defines at the distal end thereof a 90 degree circular arc surface whereby, when four similar planar members are in side-to-side tongue and groove engagement to form a right rectangular prism, a circular aperture is formed in each of two opposed end faces of the right rectangular prism with the center of the circular aperture being equidistant from all corners of the face.

5. The toy construction kit in accordance with claim 1 in which at least one said wall member defines at least one circular aperture and in which said kit further includes a flexible, cylindrical dowel member defining a slot extending the length of the dowel member whereby said dowel member may be force-inserted into one of said apertures for being compressively retained therein.

6. The toy construction kit in accordance with claim 5 in which at least one said dowel member has two end faces normal to the longitudinal axis of the dowel and in which said dowel defines on at least one end a keyhole-shaped aperture aligned with a diameter of said dowel, said keyhole-shaped aperture having a generally cylindrical bore and a generally right rectangular prism-shaped slot communicating with said cylindrical bore on one end of the slot and with said dowel end face on the other end of said slot.

7. The toy construction kit in accordance with claim 6 in which said right rectangular prism-shaped slot portion of said keyhole aperture is in alignment with said longitudinal groove.

8. The toy construction kit in accordance with claim 6 in which said longitudinal groove is perpendicular to the longitudinal axis of said keyhole cylindrical bore.

9. The toy construction kit in accordance with claim 6 in which said kit further includes a flat, polygonal-shaped panel member having a channel parallel to, and spaced inwardly of, each edge, whereby said panel may be inserted into one of said longitudinal grooves and said keyhole-shaped apertures of said dowel members.

10. In a toy construction kit in accordance with claim 6 in which said kit further includes a lock pin comprising a generally elongate first cylindrical member and a generally elongate second cylindrical member joined end-to-end, said second member having a longitudinal axis parallel to the longitudinal axis of said first member, said second member having a diameter less than said first member and larger than said dowel member keyhole cylindrical bore whereby said second member may be force-inserted into said dowel member keyhole cylindrical bore for being compressively retained therein.

11. The toy construction kit in accordance with claim 10 in which said first cylindrical member of said lock pin further has a generally right rectangular, prism-shaped slot extending for at least a portion of the length of said first member and communicating with the distal end thereof opposite said second member whereby said first member may be force-inserted into one of said apertures of one of said wall members for being compressively retained therein.

12. The toy construction kit in accordance with claim 10 in which the diameter of said first cylindrical member is equal to the diameter of said dowel member and in which the longitudinal axis of said second member is offset from the longitudinal axis of said first member.

13. The toy construction kit in accordance with claim 10 in which the distal end of said second cylindrical member is tapered to accommodate insertion of said second member into said dowel member keyhole cylindrical bore and in which the distal end of said first cylindrical member is tapered to accommodate insertion of said first member into said wall member aperture.

14. The toy construction kit in accordance with claim 8 in which said kit further includes flexible tubing for being force-inserted into at least one of said wall member circular apertures.

15. The toy construction kit in accordance with claim 5 in which said kit further includes a disc defining a central bore for receiving one of said dowel members inserted therethrough.

16. The toy construction kit in accordance with claim 15 in which said disc has a lug means projecting inwardly into said central bore and for being engaged by one of said longitudinal grooves of one of said dowel members when a dowel member is inserted through said central bore of said disc, thereby preventing rotation of said disc relative to said dowel member.

17. In a toy construction kit in accordance with claim 5 in which said kit further includes an angle block having the shape of a triangular prism having five faces, said angle block having on at least one of said faces a generally cylindrical dowel pin projecting therefrom and defining at its distal end a keyhole-shaped aperture, said keyhole-shaped aperture having a generally cylindrical bore and a generally right rectangular prism-shaped slot communicating with said cylindrical bore on one end of the slot and with the distal end of the dowel pin on the other end of the slot.

18. The toy construction kit in accordance with claim 17 in which said angle block defines a central cylindrical bore oriented along a longitudinal axis parallel to three of said five faces and perpendicular to the remaining two faces.

19. The toy construction kit in accordance with claim 18 in which each of said faces parallel to the longitudinal axis of said cylindrical bore has a dowel pin projecting outwardly from the face and perpendicular thereto.

20. The toy construction kit in accordance with claim 5 in which said kit further includes a hub, said hub having a generally hollow, cylindrical shaped wall defining a longitudinal slot extending therethrough and extending the length of the hub, said wall further defining an interior bore adapted to receive one of said dowel members in compressive engagement.

21. A toy construction kit comprising:

a plurality of interlockable planar members adapted to form composite structural members, each planar member having two major side surfaces defined by two opposed end edges and two opposed longitudinal edges, each planar member having two spaced apart, resilient wall portions defining therebetween a longitudinal groove extending along one edge of the planar member and each planar member further having a longitudinal tongue extending along the other edge, said tongue projecting outwardly from said planar member in the plane of that member, said groove being adapted to matingly receive the tongue of another similar planar member in a snap fit when the planar members are interlocked at right angles to each other, at least one said planar member defining at least one circular aperture, said kit further including a flexible, cylindrical dowel member defining a slot extending the length of the dowel member whereby said dowel member may be force-inserted into one of said apertures for being compressively retained therein, said kit further including a disc defining a central bore for receiving said dowel member inserted therethrough, said disc having a lug means projecting inwardly into said central bore for being engaged by said slot of said dowel member when said dowel member is inserted through said central bore of said disc, thereby preventing rotation of said disc relative to said dowel member.

* * * * *

UNITED STATES PATENT AND TRADEMARK OFFICE

CERTIFICATE OF CORRECTION

PATENT NO. : 4,182,072

DATED : January 8, 1980

INVENTOR(S) : Joe Much

It is certified that error appears in the above-identified patent and that said Letters Patent are hereby corrected as shown below:

In column 2, line 24, "members" should be --members.--.

In column 2, line 65, "and" should be --end--.

In column 3, line 32, "of second" should be --of a second--.

In column 7, line 55, "272" should be --275--.

In column 10, line 20, "80" should be --30--.

Signed and Sealed this

*Eighth* Day of *July 1980*

[SEAL]

*Attest:*

SIDNEY A. DIAMOND

*Attesting Officer*

*Commissioner of Patents and Trademarks*